US008322172B2

(12) United States Patent
Mizumoto

(10) Patent No.: US 8,322,172 B2
(45) Date of Patent: Dec. 4, 2012

(54) KEY CYLINDER INSTALLATION STRUCTURE

(75) Inventor: Jun Mizumoto, Aichi (JP)

(73) Assignee: Kabushiki Kaisha Tokai Rika Denki Seisakusho, Aichi (JP)

( * ) Notice: Subject to any disclaimer, the term of this patent is extended or adjusted under 35 U.S.C. 154(b) by 0 days.

(21) Appl. No.: 13/153,645

(22) Filed: Jun. 6, 2011

(65) Prior Publication Data

US 2011/0302969 A1 Dec. 15, 2011

(30) Foreign Application Priority Data

Jun. 10, 2010 (JP) ..... 2010-133010

(51) Int. Cl.
*E05B 9/08* (2006.01)

(52) U.S. Cl. ..... 70/451; 70/450; 70/77; 70/240; 70/449; 70/466; 70/237; 70/370; 411/999

(58) Field of Classification Search ..... 70/241, 70/450, 77, 240, 449, 452, 466, 237, 370, 70/448, 451; 292/DIG. 42, DIG. 29, DIG. 43; 411/999, 107

See application file for complete search history.

(56) References Cited

U.S. PATENT DOCUMENTS

| | | | | | |
|---|---|---|---|---|---|
| 1,893,406 | A | * | 1/1933 | Geraghty | 70/241 |
| 1,974,489 | A | * | 9/1934 | Flanigan | 200/43.12 |
| 2,314,489 | A | * | 3/1943 | Fennema | 277/520 |
| 2,636,762 | A | * | 4/1953 | Jameson | 292/150 |
| 2,709,909 | A | * | 6/1955 | Vigmostad | 70/142 |
| 2,795,947 | A | * | 6/1957 | Peras | 70/141 |
| 2,873,602 | A | * | 2/1959 | France et al. | 70/139 |
| 2,977,785 | A | * | 4/1961 | Beckman | 70/141 |
| 2,996,327 | A | * | 8/1961 | France et al. | 292/340 |
| 3,315,502 | A | * | 4/1967 | Skrapits et al. | 70/240 |
| 3,345,839 | A | * | 10/1967 | Brissette | 70/240 |
| 3,796,076 | A | * | 3/1974 | Miyabayashi et al. | 70/240 |
| 3,868,836 | A | * | 3/1975 | La Roche | 70/240 |
| 4,070,880 | A | * | 1/1978 | Carl | 70/240 |
| 4,073,170 | A | * | 2/1978 | Miyabayashi et al. | 70/256 |
| 4,080,812 | A | * | 3/1978 | Knott | 70/256 |
| 4,105,234 | A | * | 8/1978 | Eberhart | 292/302 |
| 4,155,233 | A | * | 5/1979 | Lira | 70/92 |
| 4,426,858 | A | * | 1/1984 | Interrante | 70/1.5 |
| 4,722,206 | A | * | 2/1988 | Nakamura et al. | 70/240 |
| 4,773,683 | A | * | 9/1988 | Nakamura | 292/216 |
| 4,828,444 | A | * | 5/1989 | Oshida | 411/437 |

(Continued)

FOREIGN PATENT DOCUMENTS

JP 2001-026220 1/2001

*Primary Examiner* — Lloyd Gall
*Assistant Examiner* — David E Sosnowski
(74) *Attorney, Agent, or Firm* — Roberts Mlotkowski Safran & Cole P.C.

(57) ABSTRACT

A key cylinder installation structure includes a key cylinder including a flange that is fixed to a trunk of a vehicle, the flange including a mounting hole through which a mounting bolt is inserted into a reference hole and a secondary reference hole, respectively, formed in the trunk, the key cylinder being operable to lock and unlock the trunk, and a pad that is attached to the flange of the key cylinder and includes a hole through which the mounting bolt is inserted and a projection projecting toward a center of the key cylinder in the hole of the pad. When the mounting bolt is inserted into the mounting hole, the projection of the pad lies between the mounting bolt and the mounting hole.

7 Claims, 6 Drawing Sheets

U.S. PATENT DOCUMENTS 5,040,390 A * 8/1991 Mistry et al. ..... 70/241
5,156,029 A * 10/1992 Heald ..... 70/55
5,186,516 A * 2/1993 Alexander et al. ..... 296/121
5,211,436 A * 5/1993 Feder ..... 296/76
5,361,612 A * 11/1994 Voiculescu et al. ..... 70/241
5,429,400 A * 7/1995 Kawaguchi et al. ..... 292/201
5,443,292 A * 8/1995 Shimada et al. ..... 292/341.16
5,768,923 A * 6/1998 Hill ..... 70/370
5,894,749 A * 4/1999 Tomaszewski et al. ..... 70/240
6,014,876 A * 1/2000 Taylor ..... 70/240
6,065,316 A * 5/2000 Sato et al. ..... 70/264
7,040,675 B1 * 5/2006 Ott et al. ..... 292/216
7,303,224 B2 * 12/2007 Kim ..... 296/76
7,334,439 B2 * 2/2008 Ruan ..... 70/224
7,387,004 B2 * 6/2008 Schutz et al. ..... 70/215
7,895,867 B2 * 3/2011 Hsieh ..... 70/379 R
7,938,460 B2 * 5/2011 Ishiguro ..... 292/336.3

* cited by examiner

100 KEY CYLINDER
300 PAD
120 FLANGE
C
C
200A STUD BOLT
200B STUD BOLT
115
130
22 REINFORCEMENT

22b REFERENCE HOLE
22C SECONDARY REFERENCE HOLE
22a
d
d
A
B
A/2
115

120a MOUNTING HOLE
120b MOUNTING HOLE
110 CYLINDER CASE
D
D
120
B+A/2
A/2

300

KEY CYLINDER INSTALLATION STRUCTURE

The present application is based on Japanese patent application No. 2010-133010 filed on Jun. 10, 2010, the entire contents of which are incorporated herein by reference.

BACKGROUND OF THE INVENTION

1. Field of the Invention

This invention relates to an installation structure for a key cylinder, in particular, an installation structure for a key cylinder in a vehicle.

2. Description of the Related Art

A latch part for maintaining a trunk door in an engaging state by engaging with a striker is fixed in a trunk of a rear part of a vehicle. For example, an outer handle is rotatably installed in a ceiling part of a mounting part of license plate, and the latch part can be operated by that the outer handle is operated from the outside. In addition, some vehicles have a structure that a key cylinder for locking and unlocking the trunk by a key operation is installed. For example, they have a structure that a key cylinder with an opener is fixed in a trunk located at the back of the vehicle together with a garnish part, and by operating the key cylinder, the striker engaged with the latch part can be unlocked from the outside, so that the trunk can be unlocked or locked (e.g., JP-A-2001-26220).

SUMMARY OF THE INVENTION

However, although the structure shown in JP-A-2001-26220 that the key cylinder is installed in an approximately horizontal state to the trunk has a good workability in the installation work of the key cylinder, in case of a structure that the key cylinder is installed from a position located below the trunk of the vehicle, it is necessary that the installation work is carried out while the key cylinder and fixing bolts for fixing the key cylinder on a side of the vehicle are supported from a lower position at the installation of the key cylinder so as not to fall, thereby the workability may be lowered.

Therefore, it is an object of the invention to solve the above-mentioned problem and provide an installation structure for a key cylinder that has a good workability in the installation work of the key cylinder even if a structure that the key cylinder is installed from a position located below the trunk is adopted.

(1) According to one embodiment of the invention, a key cylinder installation structure comprises:

a key cylinder comprising a flange that is fixed to a trunk of a vehicle, the flange comprising a mounting hole through which a mounting bolt is inserted into a reference hole and a secondary reference hole, respectively, formed in the trunk, the key cylinder being operable to lock and unlock the trunk; and a pad that is attached to the flange of the key cylinder and comprises a hole through which the mounting bolt is inserted and a projection projecting toward a center of the key cylinder in the hole of the pad, wherein when the mounting bolt is inserted into the mounting hole, the projection of the pad lies between the mounting bolt and the mounting hole.

In the above embodiment (1) of the invention, the following modifications and changes can be made.

(i) The key cylinder is installed from below the trunk of the vehicle.

(ii) A lap margin of the projection of the pad lying between the mounting bolt on a side of the reference hole and the mounting hole of the flange is set to be more than a lap margin of the projection of the pad lying between the mounting bolt on a side of the secondary reference hole and the mounting hole of the flange.

(iii) The pad comprises an elastic material.

(iv) The pad is attached to the flange at an opposite side of the reference hole and the secondary reference hole.

(v) A distance between the mounting holes of the flange is greater than a distance between the reference hole and the secondary reference hole.

(vi) The projection on the side of the reference hole has a thickness more than that of the projection of on the side of the secondary reference hole.

Points of the Invention

According to one embodiment of the invention, a key cylinder installation structure is constructed such that a pad is mounted on a flange of a key cylinder, and upon the insertion of mounting bolts projections of the pad are bent to engage the mounting bolts with the projections of the pad. Thereby, the mounting bolts are unlikely to disengage or drop down, so that the workability in installing the key cylinder can be enhanced even when the key cylinder is installed from below, as in a trunk key cylinder.

BRIEF DESCRIPTION OF THE DRAWINGS

The preferred embodiments according to the invention will be explained below referring to the drawings, wherein.

DETAILED DESCRIPTION OF THE PREFERRED EMBODIMENTS

Embodiment

Figure 1:
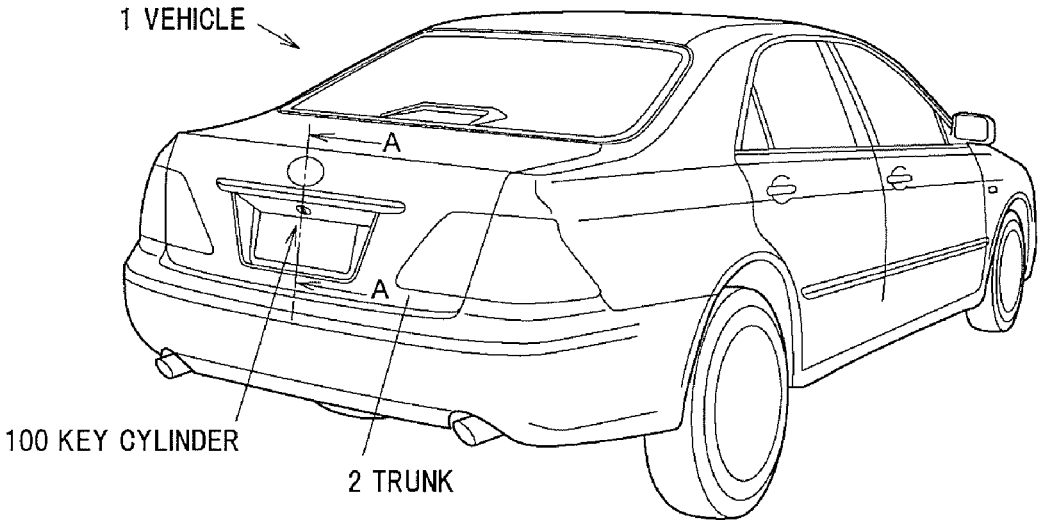
FIG. 1 is a perspective view schematically showing a trunk of a vehicle from behind to which an installation structure for a key cylinder according to one embodiment of the present invention is applied.
Figure 2:
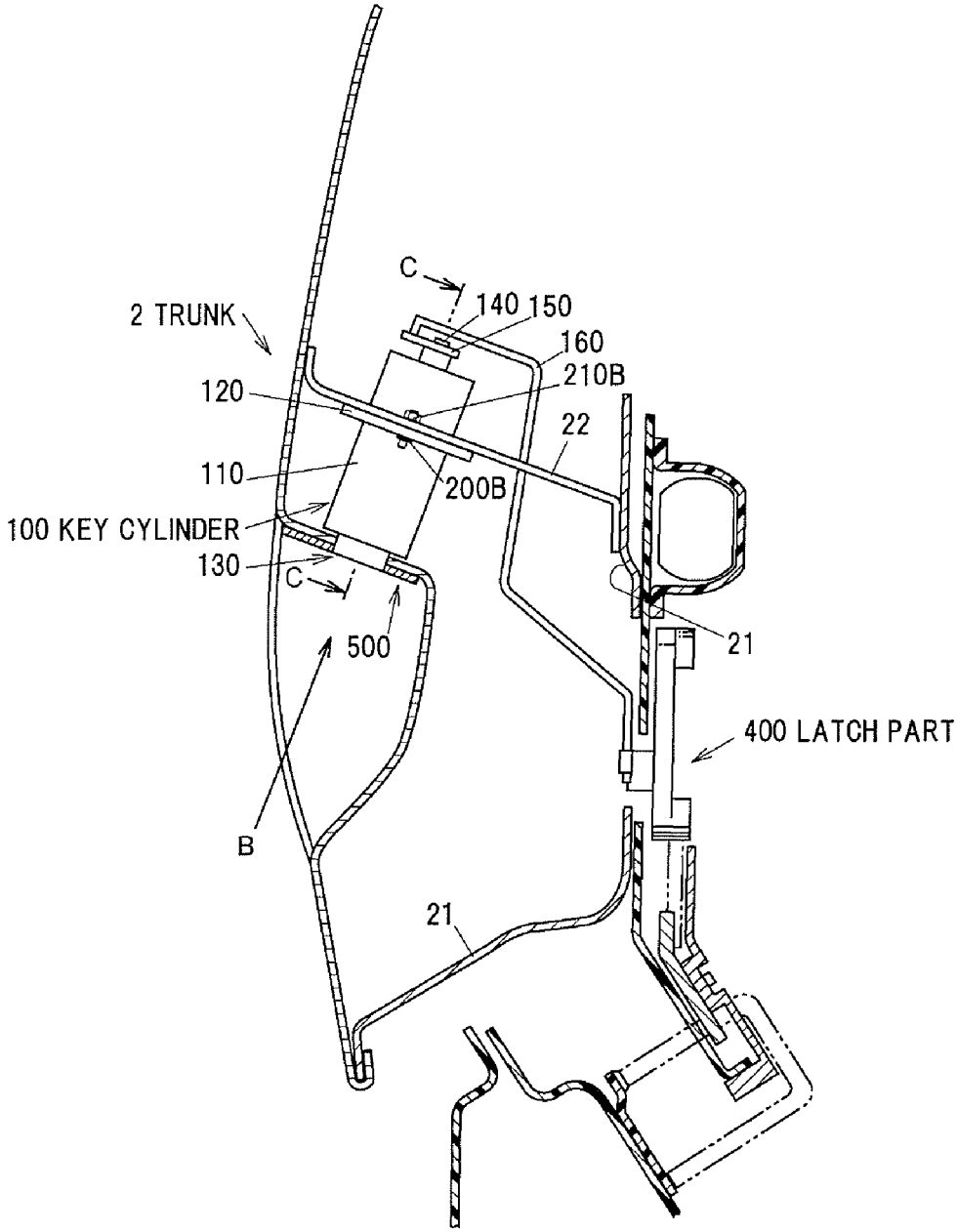
FIG. 2 is a cross-sectional view schematically showing a part of the installation structure for a key cylinder taken along the line A-A in FIG. 1.

FIG. 1 is a perspective view schematically showing a trunk of a vehicle from behind to which an installation structure for a key cylinder according to one embodiment of the present invention is applied. FIG. 2 is a cross-sectional view schematically showing a part of the installation structure for a key cylinder taken along the line A-A in FIG. 1.

A key cylinder 100 to be installed in a trunk 2 of a vehicle 1 is fixed by that a flange 120 disposed in a cylinder case 110 of the key cylinder 100 is fastened to a reinforcement 22 welded to an inner panel 21 of the trunk 2 by using stud bolts 200A, 200B and nuts 210A, 210B. The key cylinder 100 is installed from a position (B in FIG. 2) located below the vehicle 1, therefore, as the operation of the key cylinder 100, a key is inserted into a key insertion port 130 from the lower position B and is rotated so that unlocking and the like of the trunk 2 is carried out.

(Structure of Key Cylinder 100)

The key cylinder 100 includes the cylinder case 110 as a housing part having the flange 120 for mounting and fixing the cylinder case 110 on a side of the vehicle 1, and a rotor unit (not shown) housed in the cylinder case 110 and rotatable by an insertion and rotation operation of a match key K that is a proper key.

Figures 3A, 3B, 3C, 3D:
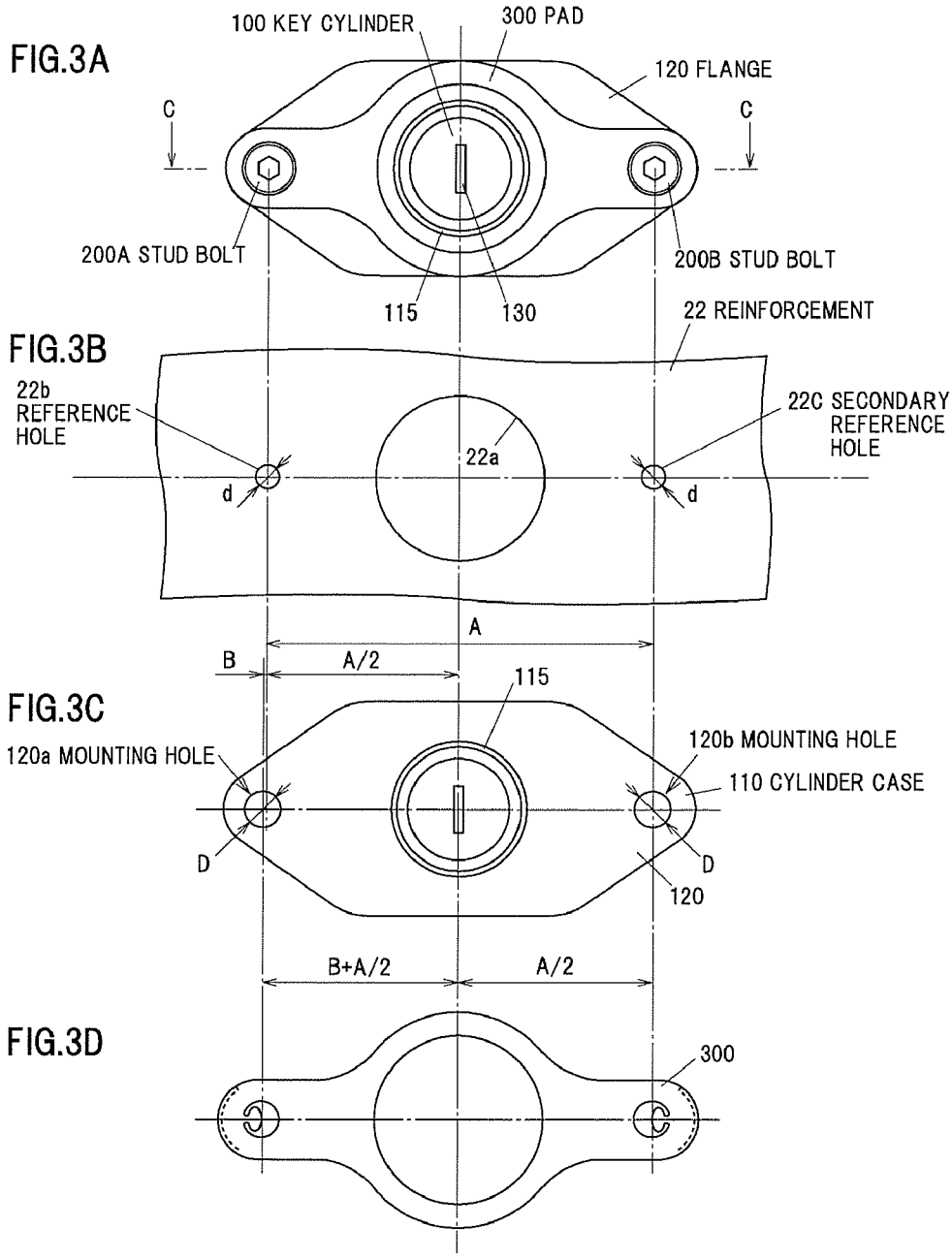
FIG. 3A is a fragmentary plan view schematically showing a key cylinder 100 installed taken in the direction of the arrow B in FIG. 2.
FIG. 3B is a fragmentary plan view schematically showing a reinforcement 22 in which the key cylinder 100 is installed taken in the direction of the arrow B in FIG. 2.
FIG. 3C is a fragmentary plan view schematically showing the key cylinder 100 taken in the direction of the arrow B in FIG. 2.
FIG. 3D is a fragmentary plan view schematically showing a pad 300 taken in the direction of the arrow B in FIG. 2.
Figure 4:
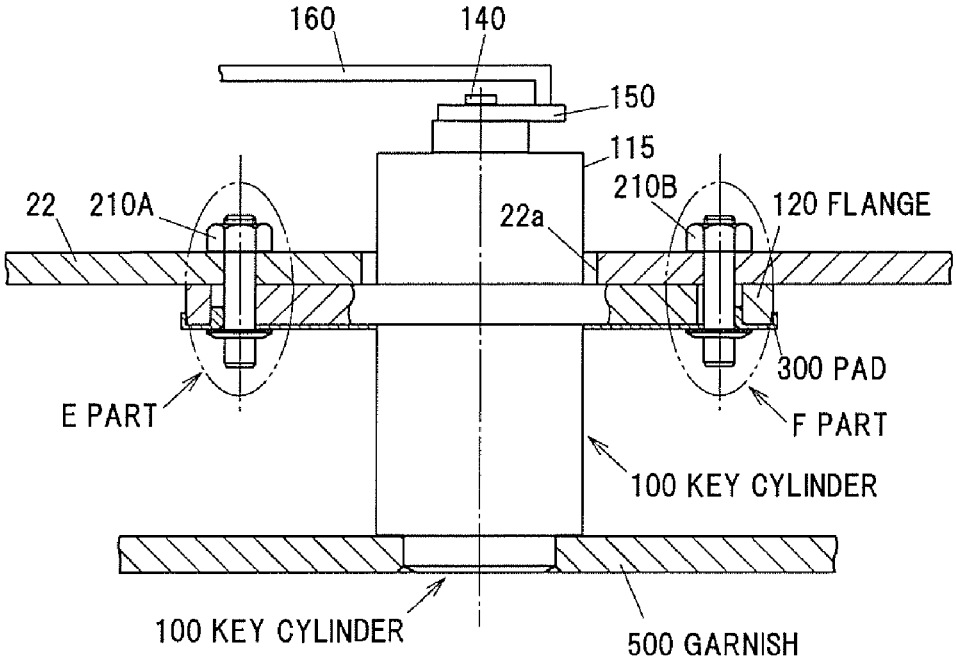
FIG. 4 is a cross-sectional view schematically showing a part of the installation structure for the key cylinder taken along the line C-C in FIGS. 2 and 3A.

FIG. 3A is a fragmentary plan view schematically showing a key cylinder 100 installed taken in the direction of the arrow B in FIG. 2, FIG. 3B is a fragmentary plan view schematically showing a reinforcement 22 in which the key cylinder 100 is installed taken in the direction of the arrow B in FIG. 2, FIG. 3C is a fragmentary plan view schematically showing the key cylinder 100 taken in the direction of the arrow B in FIG. 2, and FIG. 3D is a fragmentary plan view schematically showing a pad 300 taken in the direction of the arrow B in FIG. 2. FIG. 4 is a cross-sectional view schematically showing a part of the installation structure for the key cylinder taken along the line C-C in FIGS. 2 and 3A.

Figure 5A:
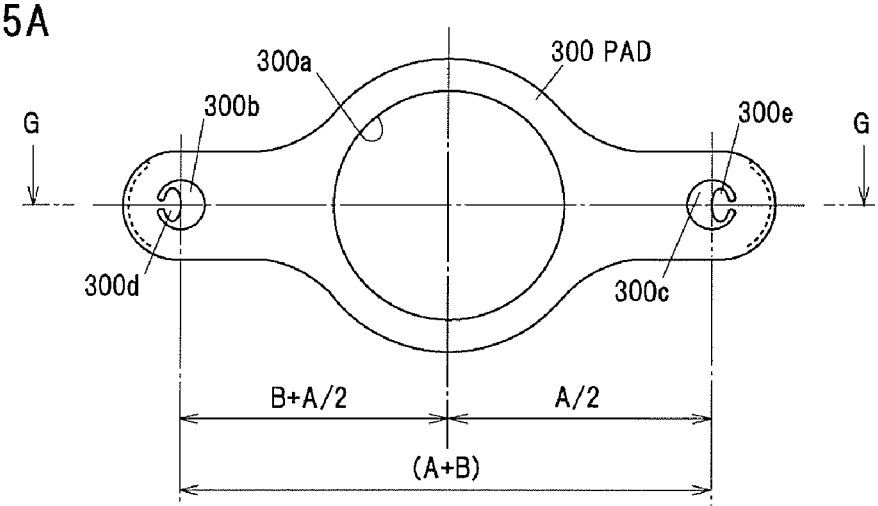
FIG. 5A is a plan view schematically showing a pad.
Figure 5B:
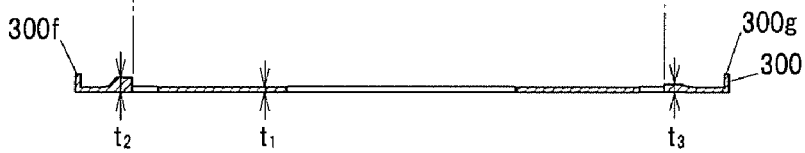
FIG. 5B is a cross-sectional view taken along the line G-G in FIG. 5A.
Figure 6A:
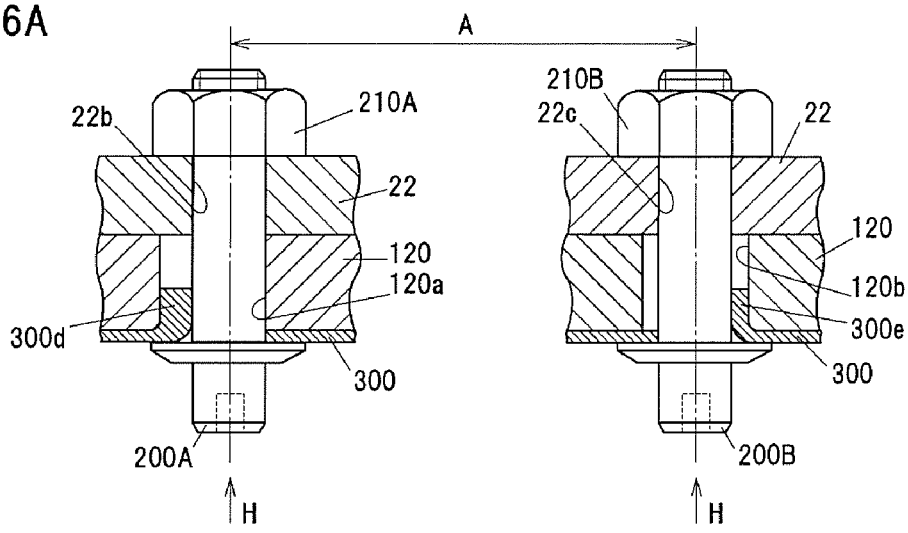
FIG. 6A is a partial enlarged view of E part and F part in FIG. 4.
Figure 6B:
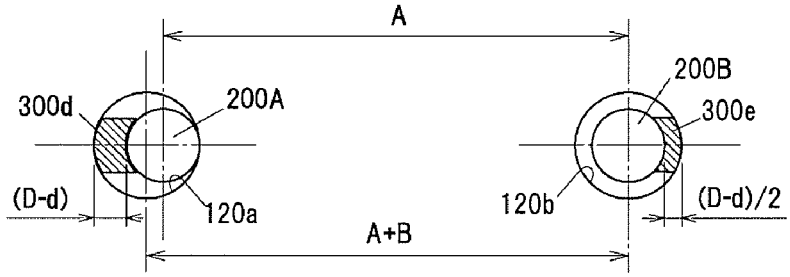
FIG. 6B is a fragmentary plan view schematically showing each hole part taken in the direction of the arrow H in FIG. 6A.

FIG. 5A is a plan view schematically showing a pad and FIG. 5B is a cross-sectional view taken along the line G-G in FIG. 5A. FIG. 6A is a partial enlarged view of E part and F part in FIG. 4 and FIG. 6B is a fragmentary plan view schematically showing each hole part taken in the direction of the arrow H in FIG. 6A. Hereinafter, based on the drawings, an installation structure for a key cylinder 100 will be explained.

As shown in FIG. 3B, in the reinforcement 22 in which the key cylinder 100 is mounted, a body hole part 22*a* that allows a body part 115 of the key cylinder 100 to pass through the body hole part 22*a* and to be housed therein, and a reference hole 22*b* and a secondary reference hole 22*c* that are corresponding to mounting holes formed in the flange 120 of the key cylinder 100.

The cylinder case 110 includes the body part 115 of a tubular shape having an interior space capable of housing the rotor unit, and the flange 120 extending from the body part 115 along the diameter direction. The flange 120 is fastened to the reinforcement 22 as a reinforcement member welded to the inner panel 21 of the trunk 2 by using stud bolts 200A, 200B and nuts 210A, 210B via the pad 300.

Tumbler fitting holes (not shown) that open to the inner periphery of the cylinder case 110 and communicate with the interior space are formed in the cylinder case 110, and by the insertion and rotation operation of the match key K, engagement between tumblers (not shown) and the cylinder case 110 is unlocked, thereby the rotor unit (not shown) becomes rotatable.

The key cylinder 100 has the key insertion port 130 through which the match key K can be inserted into and removed from the rotor unit (not shown), and is rotatably housed in the interior space of the cylinder case 110, and return characteristic is provided to the key cylinder 100 by springs (not shown) for returning the rotor. In addition, the key cylinder 100 is configured to have an operational function that the match key K is inserted into the key insertion port 130 and the rotor unit (not shown) is rotated, thereby the key cylinder 100 can be rotated from the initial position to a predetermined position so as to unlock the latch part 400.

As shown in FIG. 2, an operating rod 140 is mounted on the opposite side of the key insertion port 130 of the key cylinder 100, and the operating rod 140 is combined with a driving link 160 via a combining part 150. The driving link 160 is connected to the latch part 400. Due to the rotating operation of the key cylinder 100, the rotating motion of the operating rod 140 is transmitted by the driving link 160, thereby the unlocking operation of the latch part 400 is carried out.

As shown FIG. 3B, the reference hole 22*b* and the secondary reference hole 22*c* are formed in the reinforcement 22 so as to have a hole interval of "A" with a central focus on the body hole part 22*a*. In addition, both of the reference hole 22*b* and the secondary reference hole 22*c* are formed to have a diameter of "d".

On the other hand, as shown FIG. 3C, mounting holes 120*a*, 120*b* are formed in the cylinder case 110, the mounting holes 120*a*, 120*b* being used for allowing that the stud bolts 200A, 200B pass through the flange 120 so as to be fastened to the reinforcement 22 by the nuts 210A, 210B. The mounting holes 120*a*, 120*b* are respectively formed so as to correspond to the reference hole 22*b* and the secondary reference hole 22*c* of the reinforcement 22.

Here, a distance from the center of the cylinder case 110 to the mounting hole 120*a* is set to B+A/2 and a distance from the center of the cylinder case 110 to the mounting hole 120*b* is set to A/2, and the hole interval between the mounting holes 120*a*, 120*b* is set to A+B. In addition, both of the mounting holes 120*a*, 120*b* are formed to have a diameter of "D".

FIG. 3D is a fragmentary plan view schematically showing a pad 300 taken in the direction of the arrow B in FIG. 2. In addition, FIG. 5A is a plan view schematically showing a pad, and FIG. 5B is a cross-sectional view taken along the line G-G in FIG. 5A. The pad 300 is formed of, for example, a soft material having elasticity such as rubber. As shown in FIG. 4, the pad 300 is mounted from a side from which the stud bolts 200A, 200B are inserted into the flange 120 of the cylinder case 110.

As shown in FIG. 5A, the pad 300 is formed to have a shape corresponding to the flange 120 of the cylinder case 110 in a pan view, and a center hole 300*a* is formed in the center part, so as to allow the body part 115 to pass through the pad 300 and allow the pad 300 to be mounted in the cylinder case 110. The center hole 300*a* is formed to have a diameter larger than the body part 115.

In addition, hole parts 300*b*, 300*c* are formed so as to correspond to the mounting holes 120*a*, 120*b* formed in the flange 120 of the cylinder case 110 and so as to allow the stud bolts 200A, 200B to be inserted into and pass through the hole parts 300*b*, 300*c*. In the hole parts 300*b*, 300*c*, projections 300*d*, 300*e* are respectively formed so as to project from the edge portion of the hole parts 300*b*, 300*c* toward the center of the hole parts 300*b*, 300*c*.

As shown in FIG. 5B, the pad 300 is formed so as to have a basic thickness of t1, and the projection 300*d* is formed so as to have a thickness of t2. In addition, the projection 300*e* is formed so as to have a thickness of t3. In addition, hook parts 300*f*, 300*g* that are hooked by both end portions of the flange 120 are formed in the end portions of the pad 300 corresponding to both end portions of the flange 120.

Installation of the Key Cylinder

The installation of the key cylinder 100 in the vehicle 1 can be carried out by the following steps. The pad 300 is preliminarily mounted in the key cylinder 100. Namely, the key cylinder 100 is installed in a state that it can function as a key cylinder since the rotor unit (not shown) is mounted, and further, the pad 300 is mounted from a side from which the stud bolts 200A, 200B are inserted into the flange 120 of the cylinder case 110.

The is mounted in the flange 120 in a state that the center hole 300*a* allows the body part 115 of the cylinder case 110 to pass through, the hook parts 300*f*, 300*g* of both edge parts are hooked by both edge parts of the flange 120 and both of the pad 300 and the flange 120 come into approximately contact with each other in the each other's thickness direction.

In the above-mentioned state, an operator inserts the body part 115 of the key cylinder 100 into the body hole part 22*a* formed in the reinforcement 22 from the lower B position shown in FIG. 2. At this time, the mounting holes 120*a*, 120*b* of the flange 120 are roughly aligned so as to correspond to the reference hole 22*b* and the secondary reference hole 22*c* formed in the reinforcement 22.

In the state, the operator supports the key cylinder 100 from the low position. The stud bolt 200A is inserted into the mounting hole 120*a* of the flange 120 and the reference hole 22*b* formed in the reinforcement 22 from the lower position B shown in FIG. 2 so as to pass through the mounting hole 120*a* and the reference hole 22*b*. Similarly, the stud bolt 200B is inserted into the mounting hole 120*b* of the flange 120 and the secondary reference hole 22*c* formed in the reinforcement 22 so as to pass through the mounting hole 120*b* and the reference hole 22*c*. Relationships at the time between the stud bolt 200A and the projection 300*d* of the pad 300, and between the stud bolt 200B and the projection 300*e* of the pad 300 are shown in FIGS. 6A, 6B.

As shown in FIG. 6A, when the stud bolts 200A, 200B are inserted, the projections 300*d*, 300*e* of the pad 300 are bent toward the insertion direction according to the insertion of the stud bolts. Namely, a state shown in FIG. 6A is provided, the stud bolt 200A and the projection 300*d* of the pad 300 are engaged with each other, so that the stud bolt 200A does not easily drop out downward. Similarly, the stud bolt 200B and the projection 300*e* of the pad 300 are engaged with each other, so that the stud bolt 200B does not easily drop out downward.

Relationships between the stud bolts 200A, 200B and the projections 300*d*, 300*e* of the pad 300, and between the stud bolts 200A, 200B and the mounting holes 120*a*, 120*b* of the flange 120 become as shown in FIG. 6B. Since the pad 300 is formed of a material having elasticity such as rubber, when the projection 300*d* is fitted to a gap between the stud bolt 200A and the mounting hole 120*a* of the flange 120, as shown in FIG. 6B, the stud bolt 200A and an inner wall of the mounting hole 120*a* are brought into contact with each other. Here, if the thickness t2 of the projection 300*d* shown in FIG. 5B is set larger than a distance (D-d) of the gap between the stud bolt 200A and the mounting hole 120*a* of the flange 120 described above, the stud bolt 200A is pushed in the right direction in FIG. 6B. Thereby, the stud bolt 200A can be prevented from dropping out downward.

As described above, the thickness t2 of the projection 300*d* is set larger than the distance (D-d) of the gap, and further a dimensional relationship is set so as to meet the following. Here, the difference between the distance (D-d) of the gap and the thickness t2 of the projection 300*d* is an amount of compression within limit of elasticity, and is referred to as "lap margin (crush margin)".

On a side of the reference hole 22*b* of the reinforcement 22 shown in FIGS. 6A, 6B, as shown in FIG. 6B, the lap margin is represented as t2-(D-d). On the other hand, on a side of the secondary reference hole 22*c* of the reinforcement 22, the lap margin is represented as t3-(D-d)/2. The lap margin of t2-(D-d) on a side of the reference hole 22*b* is set larger than the lap margin of t3-(D-d)/2 on a side of the secondary reference hole 22*c*, thereby the stud bolt 200A is pushed in the right direction in FIG. 6B, so that the stud bolt 200A and the inner wall of the mounting hole 120*a* are surely brought into contact with each other as shown in FIG. 6B. Thereby, the installing location of the key cylinder 100 at the installation work can be determined with good accuracy. For example, the lap margin of on a side of the reference hole 22*b* is set to 1 mm, and the lap margin on a side of the secondary reference hole 22*c* is set to 0.5 mm, and based on this, the pad 300 is fabricated, thereby the above-mentioned technical advantage can be obtained. Here, for example, if the thickness t1 of the pad 300 shown in FIG. 5B is set to 2 mm, the thickness t2 becomes 3 mm and t3 becomes 2.5 mm.

The stud bolts 200A, 200B are fastened by the nuts 210A, 210B in a state that the stud bolts 200A, 200B are inserted into and pass through the pad 300, the flange 120 and the reinforcement 22. Namely, as shown in FIG. 6A, the flange 120 and the reinforcement 22 are tightened together with each other so as to be fixed by the stud bolts 200A, 200B and the nuts 210A, 210B. At the time, the interval between the stud bolt 200A and the stud bolt 200B is "A" as shown in FIG. 6A, so that the installing location of the key cylinder 100 at the installation work can be determined with good accuracy regardless of the value of lap margin.

After the key cylinder 100 is installed on a side of the vehicle 1, as shown in FIGS. 2, 4, the garnish 500 is mounted, thereby a series of installation process is completed.

Advantages of the Embodiment

In accordance with an installation structure for a key cylinder according to the embodiment of the present invention, the following advantages are provided.

(1) The pad 300 is mounted in the flange 120 of the key cylinder 100, and the projects 300*d*, 300*e* of the pad 300 are bent by the insertion of the stud bolts 200A, 200B, thereby the stud bolts 200A, 200B and the projections 300*d*, 300*e* of the pad 300 are engaged with each other. Thereby, the stud bolt does not easily drop out downward, so that the workability of installation work can be enhanced even if the key cylinder 100 is installed from the lower position.

(2) The lap margin on a side of the reference hole 22*b* of the reinforcement 22 is set larger than the lap margin on a side of the secondary reference hole 22*c*, thereby the stud bolt 200A is pushed in the right direction in FIG. 6B, so that the stud bolt 200A and the inner wall of the mounting hole 120*a* are surely brought into contact with each other as shown in FIG. 6B. Thereby, the installing location of the key cylinder 100 at the installation work can be determined with good accuracy.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

What is claimed is:

1. A key cylinder installation structure particularly adapted for use on a trunk of a vehicle, comprising:

a key cylinder assembly comprising a key cylinder, a flange attached to the key cylinder, the flange having a first mounting hole, and a first mounting bolt inserted through the first mounting hole of the flange, the first mounting bolt being insertable into a first reference hole formed in a trunk, the key cylinder being operable to lock and unlock the trunk; and a pad that is attached to the flange of the key cylinder that includes a center hole for receiving the key cylinder, and a first bolt hole aligned with the first mounting hole of the flange through which the first mounting bolt is inserted, the pad further including a first projection projecting from a side of the first bolt hole toward the center of the first bolt hole of the pad that is engaged between the first mounting bolt and the first mounting hole and that applies a frictional force to the first mounting bolt that is equal to or larger than the weight of the first mounting bolt to prevent the first mounting bolt from falling out of the first mounting hole.

2. The key cylinder installation structure according to claim 1, wherein the pad is formed from a deformable material, and the first pad projection is integrally formed with the pad and is bent relative to the pad when in frictional engagement between the first mounting bolt and the first bolt hole.

3. The key cylinder installation structure according to claim 1, wherein the flange includes a second mounting hole and the key cylinder assembly further includes a second mounting bolt that is inserted into the second mounting hole and which is insertable into a secondary reference hole formed in the trunk, and the pad includes a second bolt hole aligned with the second mounting hole of the flange, and the pad further includes a second projection engaged between the second mounting bolt and the second mounting hole of the flange that applies a frictional force to the second mounting bolt that prevents the second mounting bolt from falling out of the second mounting hole, and wherein a lap margin of the first projection is more than a lap margin of the second projection.

4. The key cylinder installation structure according to claim 1, wherein the pad comprises an elastic material.

5. The key cylinder installation structure according to claim 1, wherein the pad is attached on a side of the flange that faces away from the first reference hole.

6. The key cylinder installation structure according to claim 3, wherein a distance between the first and second mounting holes of the flange is greater than a distance between the first reference hole and the secondary reference hole.

7. The key cylinder installation structure according to claim 3, wherein the first projection on the side of the first mounting hole has a thickness more than that of the second projection on the side of the second mounting hole.

* * * * *